US006457277B1

(12) United States Patent
Meyers

(10) Patent No.: US 6,457,277 B1
(45) Date of Patent: Oct. 1, 2002

(54) STRAIGHT LINE SUSPENSION SYSTEM FOR KIOSKS

(76) Inventor: David O. Meyers, 726 W. 1400 South, Woods Cross, UT (US) 84087

( * ) Notice: Subject to any disclaimer, the term of this patent is extended or adjusted under 35 U.S.C. 154(b) by 0 days.

(21) Appl. No.: 09/645,908

(22) Filed: Aug. 25, 2000

Related U.S. Application Data

(60) Provisional application No. 60/150,642, filed on Aug. 25, 1999.

(51) Int. Cl.[7] ..... E04H 3/00

(52) U.S. Cl. ..... 52/36.1; 52/36.2; 52/648.1; 52/64; 312/334.27; 312/334.3; 312/223.1; 248/419; 248/676; 109/24.1; 109/50

(58) Field of Search ..... 52/36.1, 64; 312/334.27, 312/334.3, 223.1; 248/419, 676; 109/24.1, 50

(56) References Cited

U.S. PATENT DOCUMENTS 5,299,511 A * 4/1994 Dallman ..... 109/24.1
5,611,288 A * 3/1997 Dallman ..... 109/50
5,806,439 A * 9/1998 Fitts, Sr. ..... 109/24.1
5,836,256 A * 11/1998 Senterfeit ..... 109/24.1
5,971,471 A * 10/1999 Gardner ..... 296/165

* cited by examiner

*Primary Examiner*—Beth A. Stephan
*Assistant Examiner*—Christy M. Green
(74) *Attorney, Agent, or Firm*—TraskBritt

(57) ABSTRACT

An apparatus and method for support automatic teller machines (ATM's). A framework is formed and adapted to house the ATM. A support plate is positioned within the framework and is adapted to be linearly movable between two positions. The first position places the support plate entirely within the framework. The second position allows the support plate to at least partially protrude from the framework. The plate is then simply supported rather than by cantilever. Simply supporting the plate may include coupling the plate to the frame work with a pivotal linkage assembly.

12 Claims, 1 Drawing Sheet

STRAIGHT LINE SUSPENSION SYSTEM FOR KIOSKS

PRIORITY CLAIM

This application claims the benefit of U.S. Provisional Patent Application Serial No. 60/150,642, filed Aug. 25, 1999 for STRAIGHT LINE SUSPENSION SYSTEM FOR KIOSKS.

FIELD OF THE INVENTION

This invention relates to automatic teller machine (ATM) kiosks, and provides an improved suspension system for such structures.

BACKGROUND

ATM devices are often installed in stand alone buildings (kiosks) and are often located in such places as shopping malls and adjacent to surface drive up lanes. Servicing of such installations requires that the ATM device be extendable from and retractable within its kiosk housing. The extended position accommodates periodic servicing including stocking the machine with adequate currency and paper for printed statements. Similarly, the extended position allows for mechanical and electrical repairs when necessary.

A variety of mechanisms have been proposed and utilized for extending and retracting an ATM device with respect to a housing. Extension generally involves projecting a base support, outwardly from the kiosk in cantilevered fashion. Such supports experience high stresses due to the cantilevered plate and the forces distributed to adjoining members. Such high stress, combined with cyclic extension and retraction, can lead to possible fatigue failure of the support structure. The provision of adequate support for the distal portion of the base is a significant design objective. Because kiosks are normally located near a surfaced drive lane, there are practical limitations, including spatial considerations, imposed upon support design. Current designs suffer from a variety of disadvantages, including cost of construction, unreliable operation and inadequate support, resulting in drooping or sagging of the baseplate. As noted above, such disadvantages may ultimately lead to failure of the support system resulting in significant expense including the cost to repair and replace the support mechanism, as well as lost down time of the ATM. Furthermore, such failure could be a safety issue for those servicing the machine.

In view of the shortcomings in the art, it would be advantageous to provide an apparatus and a method of supporting ATM's which efficiently and adequately support the ATM while allowing necessary access to the ATM for periodic servicing and maintenance. The apparatus and method should preferably be simple in design and manufacture. The apparatus and method should also be adaptable for use in various locations having spatial or other design considerations.

SUMMARY OF THE INVENTION

In accordance with one aspect of the invention, a straight line suspension system for housing ATM kiosks is provided which overcomes the problems of currently available support designs. A baseplate is mounted relative to a bearing surface of the floor of a kiosk for approximately horizontal extension and retraction. The inboard end of the baseplate may be supported by rollers, wheels or other sliding bearings within a track. The outboard end of the baseplate is suspended from a fixed vertical support by a system of traveling members which maintain a substantially constant elevation of the outboard edge. A hypotenuse link member connects between a pivot connection at one side of the baseplate (at its outboard edge) and a sliding pivot connection carried at the upper end of the vertical support. A structural link is connected between pivot mechanisms located at the midpoint between the pivot connections of the hypotenuse link and at base level on the vertical support, respectively. Ideally, vertical supports and the associated link members are provided at opposite sides of the baseplate. Force to extend or retract the baseplate may be provided through any convenient mechanism, including belt drives, chain drives, worm drives or other forms of gearing. Motive power for the system may be provided manually, as by a hand crank, or by any appropriately sized motor or engine.

The mechanism of this invention is ideally fashioned to incorporate a classical Scott Russel Straight-line Motion arrangement, in which one end of the hypotenuse link is permitted to travel: e.g., by being pivotally connected to a sliding block. A modification of this arrangement replaces the traveling block with an oscillating link mounted at one end to a fixed pivot located such that the oscillating link will be perpendicular to a reference line connecting the block end of the hypotenuse link and the fixed pivot end of the short link when the oscillating link is in its mid position. Other straight-line linkage arrangements may be adapted for use with this invention, but are generally more complex.

In accordance with another aspect of the invention, a method is provided for supporting ATM's. The method includes providing a framework for housing the ATM. A support plate is positioned within the framework in a manner adaptable to be linear movement between two positions. The first position places the support plate entirely within the framework. The second horizontally offset position allows the support plate to at least partially protrude from the framework. The plate is then simply supported rather than by cantilever. Simply supporting the plate may include coupling the plate to the frame work with a pivotal linkage assembly.

BRIEF DESCRIPTION OF THE DRAWINGS

The foregoing and other advantages of the invention will become apparent upon reading the following detailed description and upon reference to the drawings in which.

DETAILED DESCRIPTION OF THE INVENTION

Figure 1:
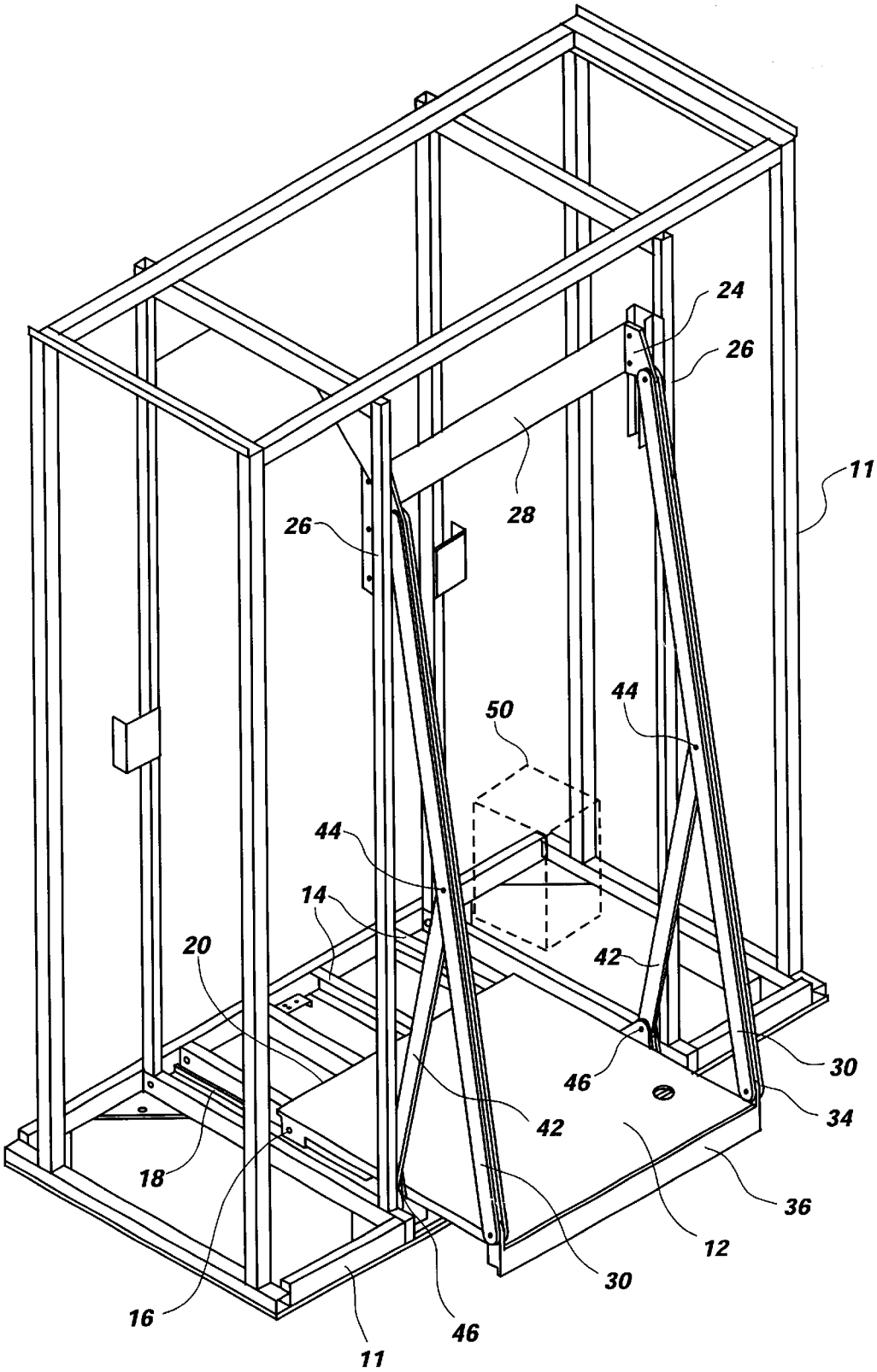
FIG. 1 is a perspective view of a kiosk frame work according to one embodiment of the present invention.

Referring to FIG. 1, frame work structure, generally 11, of an ATM kiosk which incorporates a straight line suspension system is shown. A baseplate 12 is mounted atop a plurality of generally parallel spaced apart floor braces 14. A set of wheels 16 ride within tracks 18 at the inboard edge 20 of the baseplate 12. Other rolling or sliding mechanisms may be implemented in place of the wheel 16 and track 18 system. For example, ball, roller, or slide type bearings may be implemented to facilitate linear motion of the baseplate 12 relative to the floor braces 14.

Pivot brackets 24 are mounted in sliding relationship to vertical supports 26. The pivot brackets 24 include bearing elements, such as slide bearings or other appropriate bearing elements, to facilitate linear motion along the vertical supports. Vertical supports extend upward from the floor braces 14 and help to form a generally fixed or rigid framework. The pivot brackets 24 are further held in spaced relation by the cross member 28. The cross member 28 serves to maintain the pivot brackets in substantial synchronous motion along the vertical supports 26 during extension and retraction of the baseplate 12. Hypotenuse links 30 are pivotally connected at one end to fixtures 34 mounted to opposite sides of the outboard edge 36 of the baseplate 12. The hypotenuse links 30 are also pivotally connected at their respective opposite ends to the pivot brackets 24. Support links 42 extend between pivots 44, located midway between the pivots 24 and 34 of the hypotenuse links 30, and pivot fixtures 46 mounted to the frame work structure 11.

The framework as described allows for the baseplate 12 to move linearly such that the outer edge 36 of the baseplate 12 may protrude from the frame work 11 while still maintaining adequate support for the entire baseplate 12. The forces exerted on the baseplate 12 are now transferred from the baseplate 12 to the floor braces 14 and through the hypotenuse links 30 to the vertical supports 26. The vertical supports 26 and floor braces 14 then further distribute the loading throughout the framework 11. The structure, as presented, has thus removed the cantilever loading of the baseplate 12 and replaced it with an arrangement which is simply supported. Furthermore, with the arrangement shown, extension of the baseplate 12 is accomplished such that the baseplate is always held at a right angle with respect to the vertical supports 26 throughout its range of extension and contraction. Drooping of the outboard edge 36 is relieved as is the likelihood of the baseplate 12 binding during its extension and retraction.

A drive mechanism 50 may be attached to the baseplate 12 for motivation of the baseplate 12 between the extended and retracted positions. Any of a variety of drive mechanisms may be utilized. For example, belt drives, chain drives, worm drives, rack and pinion or other forms of gearing are all considered to be adequate drive mechanisms. Additionally, the drive mechanism 50 may be powered manually or by electric or hydraulic motors. It is also contemplated that hydraulic or pneumatic cylinders may be utilized in motivating the baseplate 12. Actuators for the drive mechanism may be housed within the framework 11 and concealed by an appropriate cover or shell about the framework 11. Such actuators may be installed such that only authorized individuals have access and ability to operate the mechanism 50.

Once being appraised of the invention, those of ordinary skill in the art will be able to choose appropriate materials and construct the invention.

While the invention may be susceptible to various modifications and alternative forms, specific embodiments have been shown by way of example in the drawing and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A support system in combination with an automatic teller machine (ATM), wherein said support system includes a baseplate supporting said ATM and adapted for extension and retraction with respect to a housing such that an outboard edge of said baseplate extends from said housing and an inboard edge of said baseplate remains within said housing, said support system comprising:

a sliding support arrangement for said inboard edge of said base support, constructed and arranged to accommodate horizontal movement of said baseplate;

vertical support members located adjacent said baseplate;

sliding bracket structure, associated with said vertical support members and adapted for vertical travel with respect to said vertical support members;

hypotenuse links pivotally connected between respective sides of said outboard edge of said baseplate and said sliding bracket structure; and structural links pivotally connected between said hypotenuse links and a support structure adjacent said baseplate.

2. The support system of claim 1, further comprising a plurality of wheels coupled to said baseplate.

3. The support system of claim 1, further comprising at least one bearing mechanism coupled to said baseplate.

4. The support system of claim 3, wherein said bearing mechanism includes a roller bearing.

5. The support system of claim 3, wherein said bearing mechanism includes a slide bearing.

6. The support system of claim 1, wherein said sliding bracket structure further includes bearing elements for facilitating vertical travel along said vertical support members.

7. The support system of claim 6, wherein said bearing elements include a slide bearing.

8. A method of supporting an automatic teller machine (ATM) comprising:

providing a framework for housing said ATM;

disposing a plate within said framework, said plate being sized and configured to support said ATM;

positioning said plate for substantially linear motion between a first position within said framework and a second position wherein said plate at least partially protrudes from said framework; and coupling said plate to said framework through a pivoting linkage system, thereby simply supporting said plate during said protrusion from said framework; and placing said ATM on said plate.

9. The method according to claim 8, further comprising operably coupling a drive mechanism to said plate to effect motion thereof between said first and second positions.

10. The method according to claim 9, wherein said drive is electrically operated.

11. The method according to claim 9, wherein said drive is manually operated.

12. The method according to claim 8, further comprising coupling at least one bearing element to said plate at a location for facilitating said substantial liner motion.

* * * * *